US005647424A

United States Patent [19]

Larsen et al.

[11] Patent Number: 5,647,424

[45] Date of Patent: Jul. 15, 1997

[54] METHOD OF BILATERAL PRESSING OF MOULDS IN A MOULD-STRING SYSTEM

[75] Inventors: Jens Peter Larsen, Albertslund; Ole Oksby Hansen, Ballerup, both of Denmark

[73] Assignee: Dansk Industri Syndikat A/S, Herlev, Denmark

[21] Appl. No.: 548,553

[22] Filed: Oct. 26, 1995

[30] Foreign Application Priority Data

Nov. 1, 1994 [DK] Denmark ..... 1266/94

[51] Int. Cl.[6] ..... B22C 11/10; B22C 15/02

[52] U.S. Cl. ..... 164/18; 164/40; 164/456

[58] Field of Search ..... 164/18, 40, 456

[56] References Cited

U.S. PATENT DOCUMENTS 4,791,974 12/1988 Larsen ..... 164/40 X 4,997,025 3/1991 Post et al. ..... 164/40 X 5,332,025 7/1994 Larsen ..... 164/18 X

FOREIGN PATENT DOCUMENTS 53-144422 12/1978 Japan ..... 164/40

3-291126 12/1991 Japan ..... 164/456

*Primary Examiner*—J. Reed Batten, Jr.

*Attorney, Agent, or Firm*—Larson & Taylor

[57] ABSTRACT

A method and apparatus of forming a plurality of moulds in a string system is provided by squeeze plates which compress the particulate mould material. One of the squeeze plates is pivotable so that when a pair of squeeze plates are compressed by particulate mould material, the pivotable squeeze plate may be pivoted out of the way to provide a string mould system. In another embodiment of the invention the pivotable squeeze plate is movable laterally to provide bilateral pressing of both of the squeeze plates.

10 Claims, 3 Drawing Sheets

METHOD OF BILATERAL PRESSING OF MOULDS IN A MOULD-STRING SYSTEM

TECHNICAL FIELD

The present invention relates to a method of bilateral pressing of moulds from a compressible particulate mould material, e.g. clay-bonded green sand, in a string-moulding system, in which method a) the pressing of the mould takes place in a mould chamber between a squeeze plate provided with at least one pattern and a pivoted squeeze plate provided with at least one pattern, b) the squeeze plate can be moved b1) towards the pivoted squeeze plate for pressing the mould and b2) when the pivoted squeeze plate is pivoted out of the way, past the latter for pushing the mould out from the mould chamber and bringing it into abutment against a mould having been produced immediately before, and c) the pivoted pressing plate is movable to a limited extent through a fixed distance towards the squeeze plate during the pressing of the mould for achieving a bilateral pressing of the latter.

In the original string-moulding systems, DK patent publication No. 87,462, the pivoted squeeze plate or the counter-pressure plate remained stationary during the pressing of the mould, so that the latter was pressed unilaterally solely by the squeeze plate. Because of the particular characteristics of clay-bonded green sand, which is the material generally used for producing moulds in strings, this gave rise to differences in the degree of compaction of the sand at the pivoted plate and at the squeeze plate, hence also differences in the degrees of hardness of the mould surfaces produced at these plates. This is, of course, not quite satisfactory, since, as is well-known, two such mould surfaces on two successive moulds in the string of moulds co-operate to define a casting cavity in the latter. The result of this difference in the degree of hardness is partly that the castings will have different roughness and hence different visual appearance on two sides, partly—if one of the mould surfaces is very soft—that the molten metal is pressed into this surface, so that the casting will have local "bulges".

GB patent publication No. 803,332 suggests a bilateral pressing of a mould in a mould chamber by means of two pattern-carrying press plates movable towards each other. After pressing the mould, the pattern-carrying press plates are withdrawn from the mould chamber, and the latter is moved transversally to a position aligned with a track, on which the mould having been pressed is pushed by a ram out of the mould chamber and into abutment with a previously produced mould. At the same time, a second mould chamber adapted to be moved together with the first mould chamber, is brought in position aligned with the pressing plates, and a new mould is pressed in the second chamber. After this, the second mould chamber is moved transversally to the opposite side to a position aligned with a second track, and the mould in this second chamber is pushed by a ram out on this track into alignment with a previously produced mould, at the same time as the first mould chamber is moved back to its position aligned with the pressing plates, and a further mould is pressed in this chamber, after which the production of moulds and the formation of strings of moulds continue as described above. Purely apart from the fact that this method is described in the patent publication primarily as carried out in connection with so-called $CO_2$ sand, i.e. sand having a bonding agent in the form of sodium water glass, which is hardened in the mould chambers by blowing $CO_2$ through the moulds, it is based upon the use of a string-moulding system, that compared to the system described in DK patent publication No. 87,462 exhibits an extremely complicated mechanical construction and is adapted to produce two strings of otherwise uniform moulds that have to be cast and shaken out separately.

In a further development of the string-moulding system described in DK patent publication No. 87,462, the pivoted squeeze plate has been made movable to a limited extent through a fixed distance towards and away from the squeeze plate, i.a. to extricate one pattern or a number of patterns on the pivoted squeeze plate completely from the mould, or in order to make the pivoted squeeze plate come quite clear of the mould when pivoted up to its position quite outside the limits of the mould chamber, but this capability of limited movement, e.g. to an extent of approximately 5 mm, has also been used in attempts to achieve a bilateral pressing of the mould, such as referred to initially.

This does, however, give rise to certain problems. Thus, if the movement of the pivoted plate towards the squeeze plate is initiated too early during the pressing of the mould, it will in fact not contribute to the pressing of the latter, but functions solely as an otherwise stationary pivoted plate having been moved through said fixed distance into the mould chamber. This means that the desired bilateral pressing of the mould will not be attained, neither will for this reason the desired reduction of the differences between the degree of hardness of the two mould surfaces on the mould be attained. If, on the other hand, the movement of the pivoted plate towards the squeeze plate is initiated too late during the pressing of the mould, there is a risk that the pivoted plate will not move to the full extent of the fixed distance towards the squeeze plate before the pressing of the mould is complete. This means that the limited capability of movement of the pivoted plate is not utilized optimally for bilateral pressing of the mould.

It is the object of the present invention to provide a method of the kind referred to initially, with which it is possible to attain an optimal bilateral pressing of the mould and hence an optimal equalization of the degrees of hardness of the two mould surfaces on the mould, and this object is achieved with a method, according to the invention being characterized in d) that initially, a unilateral pre-compression is imparted to the mould material by moving solely the squeeze plate or the pivoted squeeze plate in the mould chamber towards the substantially stationary pivoted squeeze plate or squeeze plate, respectively, said pre-compression being selected on the basis of the instantaneous properties of the mould material, the patterns being used and/or a previous trial pressing of moulds, e) that in immediate and continuous extension of said pre-compression, the squeeze plate and the pivoted squeeze plate are moved simultaneously towards each other for achieving the bilateral pressing of the mould, and f) that the degree of pre-compression is currently adjusted.

Thus, the method according to the invention comprises a first alternative, in which during the pre-compression stage, the squeeze plate moves towards the stationary pivoted squeeze plate, and a second alternative, in which during the pre-compression stage, the pivoted squeeze plate moves towards the stationary squeeze plate. Normally, the first alternative will be preferred, in any case when using a highly compressible mould material, due to the squeeze plate—in contrast to the pivoted squeeze plate—being movable to a far greater extent.

A first embodiment of the method according to the invention is characterized in that the selected degree of pre-compression of the mould material is achieved by moving the squeeze plate through a certain distance towards the stationary pivoted squeeze plate.

In this manner, the certain distance referred to is determined on the basis of the theological characteristics of the mould material, e.g. its flowability and compressibility, and of the patterns being used, in such a manner that the succeeding bilateral pressing proceeds in an optimal manner.

Since the rheological characteristics of the mould material mentioned may, even though efforts are made to keep them constant, change somewhat during the production of a string of moulds—e.g. when using clay-bonded green sand—a small change in its water content may cause appreciable changes in its flowability and compressibility—it is preferred that the certain distance constitutes a fixed percentage of the sum of the paths of movement of the squeeze plate and the pivoted squeeze plate during the pressing of the mould. This will, inter alia, make the given pre-compression independent of the thickness of the mould as measured between its mould surfaces.

A second embodiment of the method according to the invention is characterized in that the selected degree of pre-compression is achieved by moving the squeeze plate or the pivoted squeeze plate towards the substantially stationary pivoted squeeze plate or the squeeze plate, respectively, until the squeeze plate or the pivoted squeeze plate, respectively, being moved exerts a certain compacting pressure on the mould material.

In case the movements towards each other of the squeeze plate and the pivoted squeeze plate are implemented by hydraulic linear motors with the same conversion ratio between compacting pressure and hydraulic pressure, it is possible to proceed in such a manner that the attainment of said certain compacting pressure on the mould material is established by the attainment of the corresponding pressure in the hydraulic liquid causing the movement of the squeeze plate or the pivoted squeeze plate, respectively.

If so, it is possible to proceed in such a manner, that the pressure in the hydraulic liquid corresponding to the attainment of said certain compacting pressure on the mould material constitutes a fixed percentage of the maximum pressure in said liquid during the bilateral pressing of the mould.

A preferred modification of this embodiment of the method according to the invention is characterized in a) that during the pre-compressing of the mould material, the squeeze plate is moved towards the pivoted squeeze plate, b) that during said movement, the pivoted squeeze plate is first moved through a small distance in the same direction as the squeeze plate, c) that after this, the pivoted squeeze plate is held stationary during the remainder of the pre-compressing step while exerting an increasing compacting pressure on the mould material, until said certain compacting pressure on the mould material is attained, and d) that said certain compacting pressure is maintained through a certain period of time during the bilateral pressing of the mould.

In this manner, it has proved possible to achieve a quite extensive equalization between the degree of hardness of the two mould surfaces on the moulds. Admittedly, this embodiment entails a slight increase in the cycle time for producing moulds. The short distance, through which the pivoted squeeze plate moves in the same direction as the squeeze plate, may be of the order of magnitude 3–4 mm, and the certain period of time, during which the pressing force is maintained, may amount to between 0.1 and 0.5 second.

A third embodiment of the method according to the invention is characterized in that the degree of pre-compressing selected is achieved by, during a certain period of time, moving the squeeze plate or the pivoted squeeze plate, respectively, towards the stationary pivoted squeeze plate or the squeeze plate, respectively, and if so, it is possible to let said certain period of time constitute a fixed percentage of the time used for pressing a mould.

With each of the embodiments of the method according to the invention referred to above, it is preferred that the pressing of each mould is controlled by a computer on the basis of values of the control parameters set forth in the claims and inputted in the computer, as well as data currently being supplied to the computer and relating to the movements of the squeeze plate and the pivoted squeeze plate and/or the pressure in the hydraulic liquid and/or the time used for pressing a mould. By proceeding in this manner, the pressing of the moulds will to a great extent be independent of inevitable variations during the preparation of the mould material and hence in the latter's theological characteristics, since such variations will immediately be reflected in the data supplied to the computer and may be accounted for by the control commands issued by the computer in such a manner, that the moulds being produced are pressed as uniformly as possible.

BRIEF DESCRIPTION OF THE DRAWINGS

In the following detailed portion of the present description, the invention will be explained in more detail with reference to the exemplary preferred embodiments shown in the drawing, in which FIGS. 1*a*, 1*b* and 1*c* diagrammatically illustrate three stages during the production of a mould according to a first embodiment of the method according to the invention, FIGS. 2*a*, 2*b* and 2*c* likewise diagrammatically illustrate the positions of the pivoted squeeze plate and the squeeze plate in the mould chamber during the embodiment illustrated in FIG. 1 before and after the pressing of the mould, after pre-compression of the mould material by means of the squeeze plate and after the bilateral pressing of the mould using the pivoted squeeze plate and the squeeze plate, respectively, and FIGS. 3*a*, 3*b* and 3*c* in a similar manner as in FIGS. 2*a*, 2*b* and 2*c* show a second embodiment of the method according to the invention with the positions of the pivoted squeeze plate and the squeeze plate prior to the pressing of the mould, at the end of the pre-compression and after the bilateral pressing, respectively.

DESCRIPTION OF THE PREFERRED EMBODIMENTS

Figure 1B:
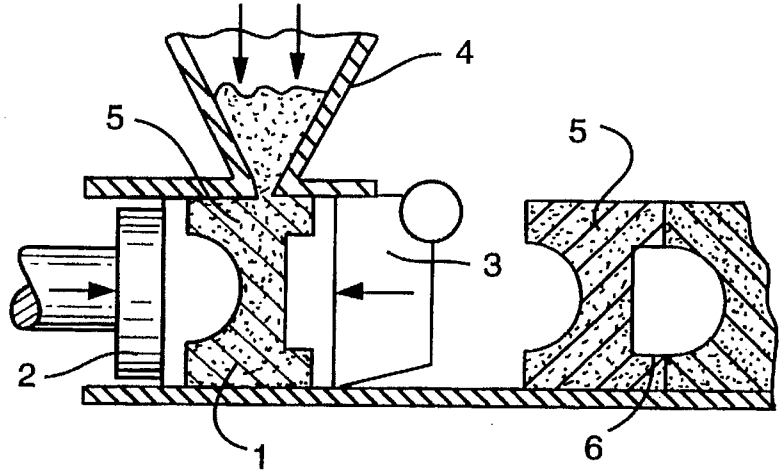
Figure 1A:
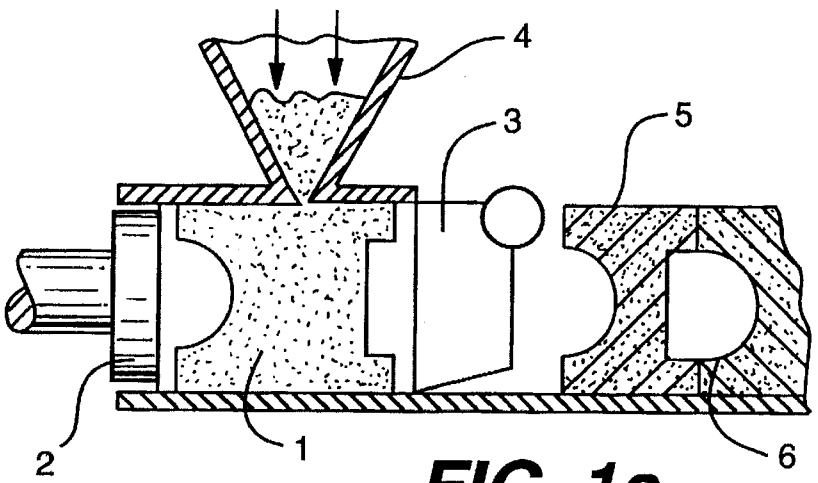

In FIG. 1*a*, a mould chamber 1 is shown, of which one end is closed by a squeeze plate 2 carrying a pattern, the other end being closed by a pivoted squeeze plate 3 carrying a pattern, in this figure shown in its lowermost position. The mould chamber 1 is filled with a compressible mould material from a hopper 4. To the right in this figure are shown two previously produced moulds 5, resting and being conveyed stepwise on a plane base 6, the top of which is aligned with the bottom of the mould chamber 1.

FIG. 1*b* illustrates the bilateral pressing of a mould 5 in the mould chamber 1 by movement of the squeeze plate 2 inwardly in the mould chamber 1 and movement of the pivoted plate 3 through a fixed distance into the mould chamber 1 under the influence of equally large and oppositely directed pressing forces, in this figure being symbolized by arrows.

Figure 1C:
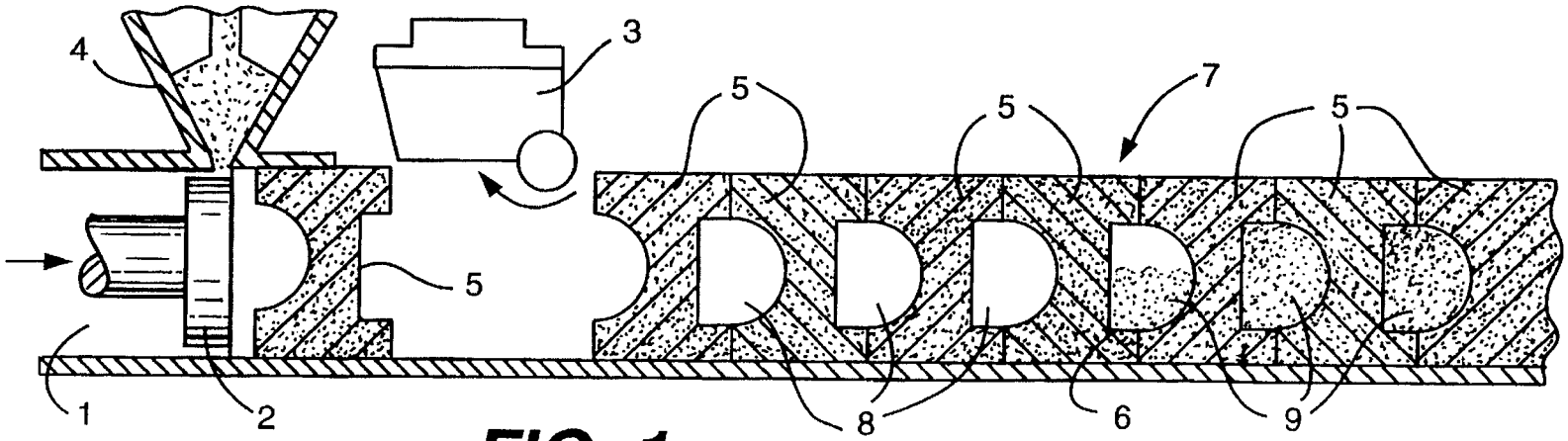

Finally, FIG. 1*c* illustrates the situation, in which the pivoted plate 3 has been withdrawn from the mould chamber 1 and pivoted upwardly in the direction shown by an arrow to a position, in which all of it is positioned at a level higher than the upper limiting level of the mould chamber 1, thus allowing free passage below for the freshly pressed mould 5 being pushed out of the mould chamber 1 by the squeeze plate 2 into abutment against the extreme left-hand one of the previously produced moulds 5 and further, until it occupies the position previously occupied by said mould, pushing the string of moulds generally designated 7 one step towards the right in the figure through a distance equal to the width of a mould 5 as measured in the longitudinal direction of the string of moulds 7. Between the moulds 5 casting cavities 8 are formed, of which one is in the process of being cast with metal 9, whereas the two cavities to the extreme right in the figure have already been cast with metal 9. During the further movement of the string of moulds 7, the metal 9 in the casting cavities 8 solidifies, and finally, the moulds 5 with the solidified castings end up on a shake-out grate (not shown), on which the mould material is separated from the castings.

Figure 2A:
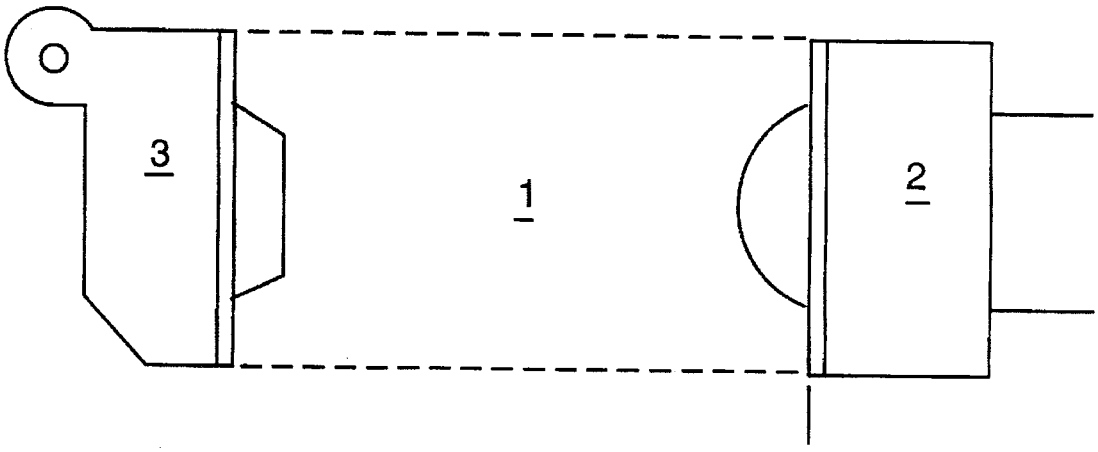
Figure 2B:
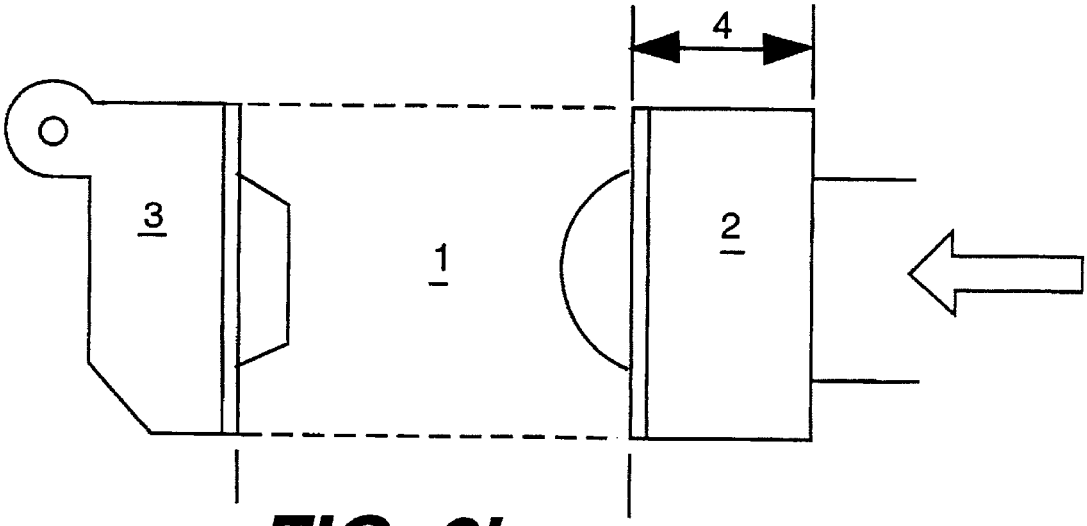
Figure 2C:
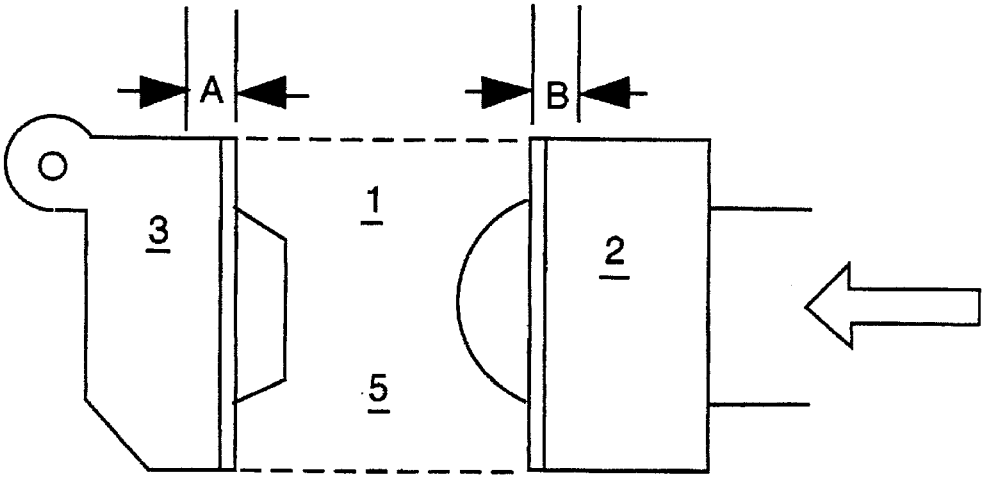

FIG. 2 illustrates diagrammatically the movements of the squeeze plate 2 and the pivoted plate 3 into the mould chamber 1 during the process of pressing a mould 5 in a first embodiment of the method according to the invention. In this figure, FIG. 2*a* illustrates the same situation as FIG. 1*a*, in which the mould chamber 1 has just been filled with mould material, but before the pressing of the latter. FIG. 2*b* illustrates the situation at the moment in time, in which the squeeze plate 2, acted upon by a force symbolized by an arrow, has moved through a predetermined distance L into the mould chamber 1 against the stationary pivoted plate 3, thus having imparted a selected pre-compression to the mould material in the mould chamber 1. Finally, FIG. 2*c* illustrates the situation after the bilateral pressing of a mould 5 in the mould chamber 1, in which the pivoted plate 3 has moved through the fixed distance A into the mould chamber 1 acted upon by a force symbolized by an arrow, at the same time as the squeeze plate 2, likewise acted upon by a force symbolized by an arrow, has moved further through the distance B into the mould chamber 1. Since the movement of the squeeze plate 2 takes place continuously through the distance L and the distance B, and the movement of the pivoted plate 3 through the distance A takes place at the same time as the squeeze plate 2 moves through the distance B, the bilateral pressing in the method according to the invention causes no increase of the cycle time of the string-moulding system as compared to unilateral pressing of moulds.

As indicated above it is preferred that the distance L constitutes a fixed percentage of the sum of the paths of movement towards each other of the squeeze plate 2 and the pivoted plate 3 during the pressing of the mould 5, i.e.:

$$\frac{L \times 100}{L+A+B} = a \text{ constant } K$$

Figure 3A:
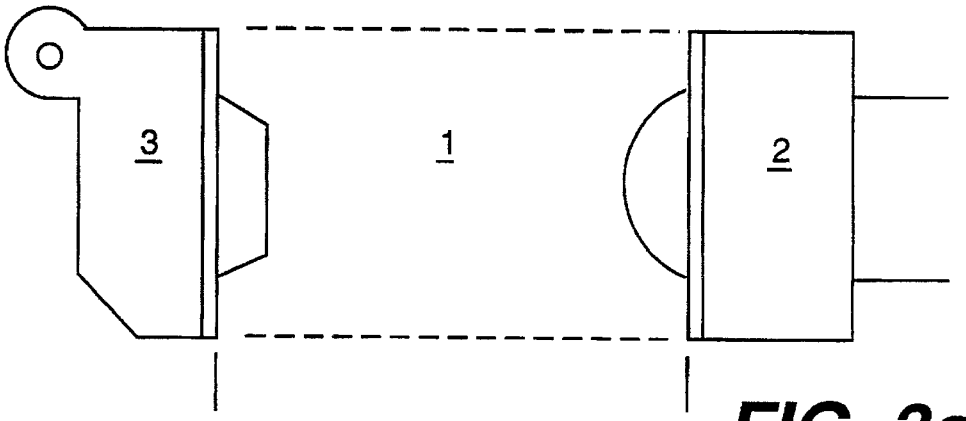
Figure 3B:
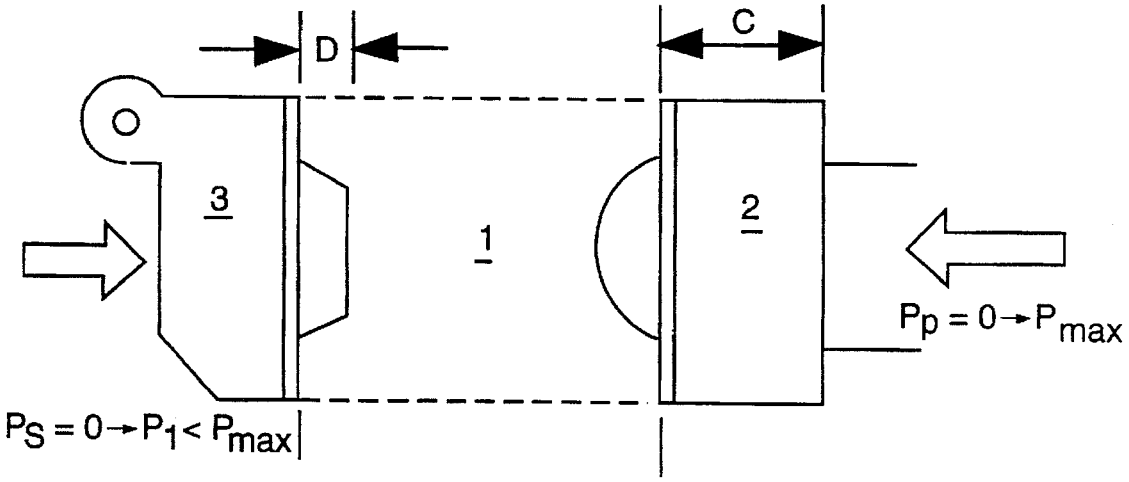
Figure 3C:
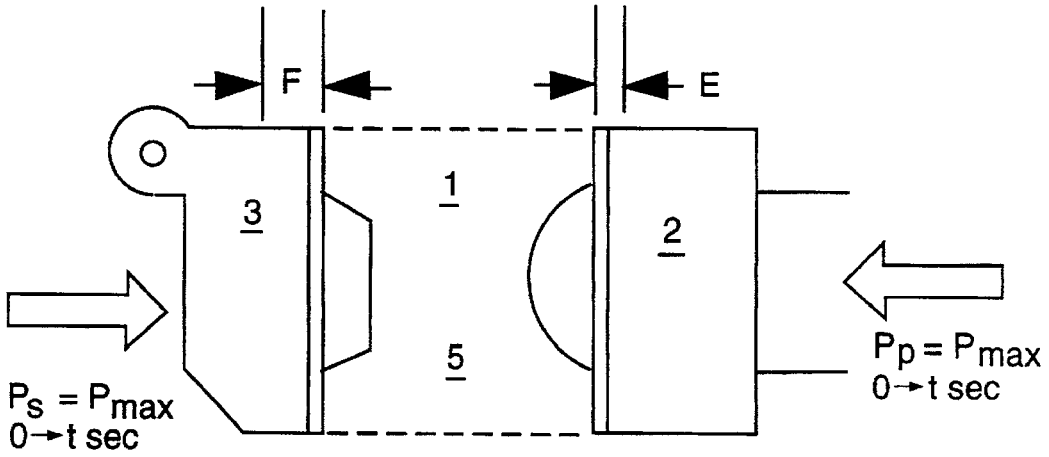

In a similar way to that of FIG. 2, FIG. 3 illustrates a preferred modification of the second embodiment of the method according to the invention. In this case, FIG. 3*a* illustrates the same situation as FIGS. 1*a* and 2*a*, in which the mould chamber 1 has just been filled with mould material, but before compaction of the latter. FIG. 3*b* illustrates the situation at the end of the pre-compressing stage, during which the squeeze plate 2 is moved towards the pivoted plate 3 exerting on the mould material a pressing force $P_p$ increasing from 0 to a certain value $P_{max}$, the squeeze plate 2 during this step moving through a distance C. In the beginning of the pre-compression step, the pivoted plate 3 is moved through a small distance D in the same direction as the squeeze plate 2 and is then held in this position by exerting on the mould material a pressing force $P_s$ increasing from 0 to a value $P_1$, the latter being less than $P_{max}$. Finally, FIG. 3*c* illustrates the situation at the completion of the bilateral pressing of the mould 5. During this step, the squeeze plate 2 still exerts the pressing force $P_{max}$ on the mould material, while the pressing force exerted on the latter by the pivoted plate 3 is increased from $P_1$ to $P_{max}$, and the pressing forces $P_{max}$ now being exerted on the mould material by both the squeeze plate 2 and the pivoted plate 3, are maintained for a time t. This causes the squeeze plate 2 to be moved through the distance E towards the pivoted plate 3, at the same time as the latter is moved through the distance F towards the squeeze plate 2.

Compared to the embodiment illustrated in FIG. 2, it will be seen that during the bilateral pressing of the mould 5 according to the embodiment illustrated in FIG. 3, the path of movement of the pivoted plate 3 has been increased, enabling the pivoted plate 3 to compress the adjacent mould material to a higher degree of hardness, this being an advantage since during the pre-compression step, the mould material is compacted to a lower degree close to the pivoted plate 3 than close to the squeeze plate 2, for which reason it is desirable to compress the former mould material to a higher degree during the bilateral pressing than the mould material close to the squeeze plate 2. As mentioned above, the pressing force $P_{max}$ is maintained on both the squeeze plate 2 and the pivoted plate 3 through a certain period of time t, this again causing a higher degree of compression of the mould material at the pivoted plate 3 than at the squeeze plate 2. This provides for an additional equalizing of differences between the degrees of mould hardness of the two mould surfaces on the mould 5.

As mentioned above, the small distance D may e.g. be 3–4 mm, and the time t can be from 0.1 to 0.5 second.

It is, of course, possible to carry out the method according to the invention with any kind of compressible particulate mould material, thus also with the $CO_2$ sand referred to previously or with e.g. resin-bound sand, and the particulate material does not necessarily have to be a quartz sand, but may e.g. be olivine sand, zircon sand or chromite sand, or otherwise any suitable particulate material bonded by a suitable bonding agent.

The commonly used material for producing moulds in strings in the manner referred to above is, however, clay-bonded green sand, especially so-called "synthetic" mould sand with bentonite as the bonding agent and a relatively pure quartz sand as the basis sand, the sand being mixed with a water content of e.g. 4–8%.

Compared to the $CO_2$ sand referred to above, such a mould sand exhibits a high degree of compressibility, but a low degree of flowability (both these characteristic properties may be determined by means of so-called "technological" testing methods), these properties naturally having an inverse relation to each other. With unilateral pressing of a mould from such a clay-bonded green sand, this means that the latter due to its inferior flowability only with difficulty fills the interspaces between protruding pattern parts on the pivoted plate or between such protruding parts and the internal boundaries of the mould chamber. It is not least this disadvantage that may be remedied by means of the bilateral pressing of moulds according to the invention, so that the mould sand will also in these regions be compacted to provide a suitable degree of hardness.

We claim:

1. A method of bilateral pressing of moulds from a compressible particulate mould material in a string-moulding system comprising a means for pressing a mould in a mould chamber between a squeeze plate having at least one pattern and a pivoted squeeze plate having at least one pattern, wherein said squeeze plate and said pivoted squeeze plate are movable towards each other, said method comprising:

a) imparting a unilateral pre-compression to the mould material by moving either only said squeeze plate toward said pivoted squeeze plate or only said pivoted squeeze plate toward said squeeze plate, wherein the amount of said pre-compression is adjustable;

b) moving said squeeze plate and said pivoted squeeze plate simultaneously towards each other to achieve bilateral pressing of the mould material;

c) pivoting said pivoted squeeze plate to allow the mould to be pushed beyond said pivoted squeeze plate;

d) moving said squeeze plate past said pivoted squeeze plate to push the mould beyond said pivoted squeeze plate.

2. A method according to claim 1, wherein said pre-compression of the mould material is imparted by moving said squeeze plate a distance L toward said pivoted squeeze plate.

3. A method according to claim 2, wherein said distance L is a fixed percentage of the sum of the distances of movement of said squeeze plate and said pivoted squeeze plate during said bilateral pressing of the mould material.

4. A method according to claim 1, wherein said amount of pre-compression is determined by moving either said squeeze plate or said pivoted squeeze plate until a predetermined pressure is exerted on the mould material.

5. A method according to claim 4, wherein said movement of said squeeze plate and said pivoted squeeze plate during said pre-compression and said bilateral pressing of the mould material is implemented by at least one hydraulic linear motor having a hydraulic input pressure and a compacting pressure and a conversion ratio between said hydraulic input pressure and said compacting pressure and wherein the pressure exerted on the mould material during pre-compression is determined by measuring said hydraulic input pressure.

6. A method according to claim 5, wherein said hydraulic input pressure corresponding to said predetermined pressure exerted on the mould material during pre-compression is a predetermined percentage of the maximum hydraulic input pressure attained during said bilateral pressing of the mould material.

7. A method according to claim 5, wherein, during pre-compression, said pivoted squeeze plate is first moved a small distance in the same direction as said movement of said squeeze plate and, thereafter, said pivoted squeeze plate is held stationary until the pressure exerted on the mould material during pre-compression reaches said predetermined pressure, said predetermined pressure thereafter being maintained through said bilateral pressing of the mould material.

8. A method according to claim 1, wherein said pre-compression is imparted to the mould material by moving either said squeeze plate or said pivoted squeeze plate for a predetermined period of time.

9. A method according to claim 8, wherein said predetermined period of time is a predetermined percentage of the time elapsed during bilateral pressing of the mould material.

10. A method according to claim 1, wherein the pressing of the mould is controlled by a computer and wherein parameters determining the amount of pre-compression are input to said computer.

* * * * *

UNITED STATES PATENT AND TRADEMARK OFFICE

CERTIFICATE OF CORRECTION

PATENT NO. : 5,647,424

DATED : July 15, 1997

INVENTOR(S) : LARSEN et al.

It is certified that error appears in the above-indentified patent and that said Letters Patent is hereby corrected as shown below:

Column 3, line 8, delete "theological" and insert --rheological--.

Column 4, line 25, delete "theological" and insert --rheological--.

Signed and Sealed this

Twenty-eighth Day of October, 1997

*Attest:*

Bruce Lehman

BRUCE LEHMAN

*Attesting Officer*

*Commissioner of Patents and Trademarks*